United States Patent [19]

Holtsch

[11] Patent Number: 4,756,423

[45] Date of Patent: Jul. 12, 1988

[54] INDICATOR FOR TAKING MEDICATION

[75] Inventor: Ernst P. Holtsch, Taunusstein-Wingsbach, Fed. Rep. of Germany

[73] Assignee: Holtsch Metallwarenherstellung, Taunusstein-Wingsbach, Fed. Rep. of Germany

[21] Appl. No.: 896,742

[22] Filed: Aug. 7, 1986

[30] Foreign Application Priority Data

Aug. 7, 1985 [DE] Fed. Rep. of Germany ..... 3528293

[51] Int. Cl.[4] ..... B65D 85/56

[52] U.S. Cl. ..... 206/534; 40/491; 40/495; 206/459; 206/533

[58] Field of Search ..... 40/453, 454, 491, 492, 40/493, 495, 496; 206/533, 534, 534.1, 538, 539, 459

[56] References Cited

U.S. PATENT DOCUMENTS

| | | | |
|---|---|---|---|
| 1,421,219 | 6/1922 | Harmon . | |
| 1,755,995 | 7/1927 | Lamb . | |
| 1,868,903 | 7/1932 | Jennings | 40/495 |
| 2,298,730 | 10/1942 | Alvari | 40/491 |
| 2,385,732 | 9/1945 | Redding | 40/495 |
| 2,666,581 | 4/1949 | Smith . | |
| 2,805,024 | 9/1957 | Olson . | |
| 2,953,242 | 9/1960 | Shaw | 206/534 |
| 3,227,127 | 1/1966 | Gayle | 206/534 |
| 3,297,198 | 1/1967 | Wright, Jr. | 206/534 |
| 3,431,885 | 3/1969 | Miklas | 40/491 |
| 3,454,152 | 7/1969 | Immermann et al. | 206/534 |
| 4,041,628 | 8/1977 | Sasson | 40/495 |
| 4,223,801 | 9/1980 | Carlson | 206/533 |
| 4,572,376 | 2/1986 | Wrennall | 206/534 |

FOREIGN PATENT DOCUMENTS

| | | | |
|---|---|---|---|
| 0745481 | 11/1966 | Canada | 206/534 |
| 0003423 | 1/1979 | European Pat. Off. . | |
| 2511528 | 3/1975 | Fed. Rep. of Germany . | |

*Primary Examiner*—Jimmy G. Foster
*Attorney, Agent, or Firm*—Michael J. Striker

[57] ABSTRACT

An indicator for taking medication having a first plate with a background color and at least one colored portion of a different color, a second plate independently movable on the front face and having a images formed so that the colored portion is visible through at least one of them so as to form a plurality of indicator positions. The plates are movable relative to one another and releasably fixable in each of the indicator positions in which the colored portion is visible through a respective one of the images. In addition, the center area of the plate may have its own images and be independently movable relative to a surrounding outer ring. Further, a pill dispenser with a plurality of radial grooves containing pills may be attached under the second plate. The first and second plates have openings; when they are aligned, any pill within the corresponding groove may be removed.

17 Claims, 5 Drawing Sheets

FIG. 1
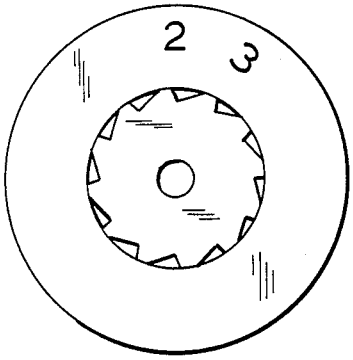
FIG. 1a
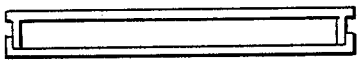
FIG. 2a
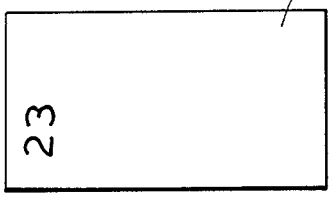
FIG. 2b
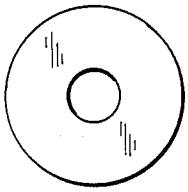
FIG. 2c
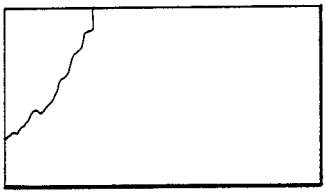
FIG. 3a
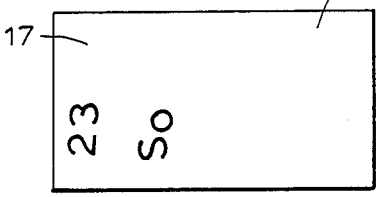
FIG. 3b
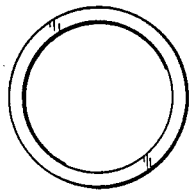
FIG. 3c
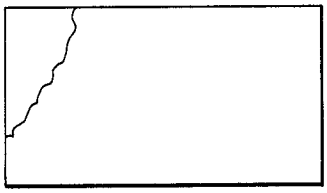
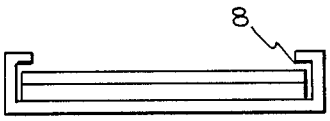
FIG. 4a
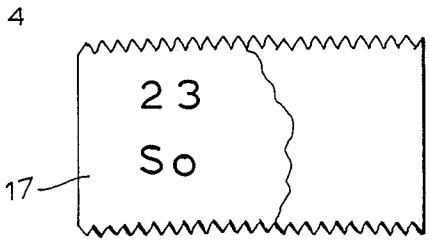
FIG. 4b FIG. 9
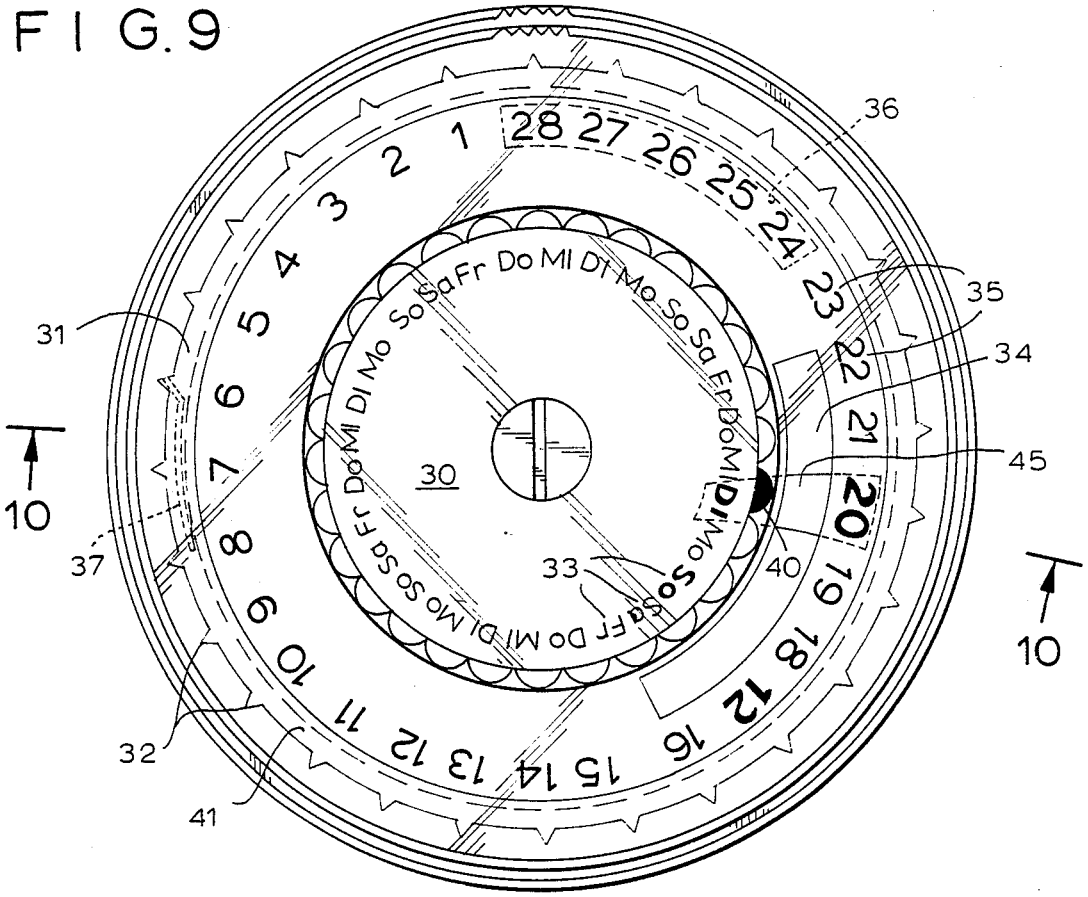
FIG. 10
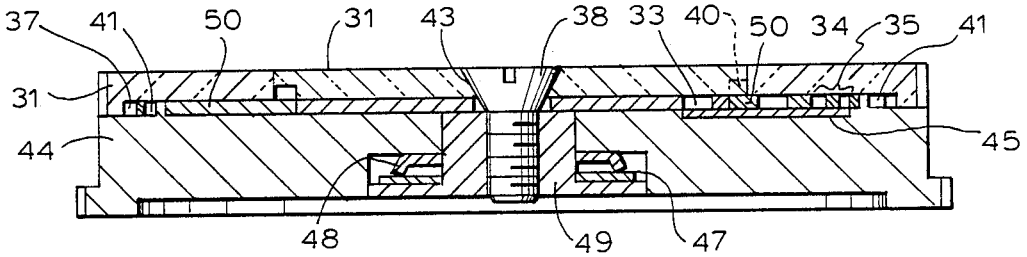
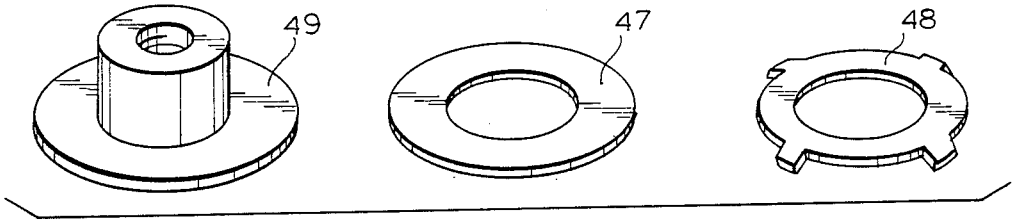
FIG. 11

FIG.12
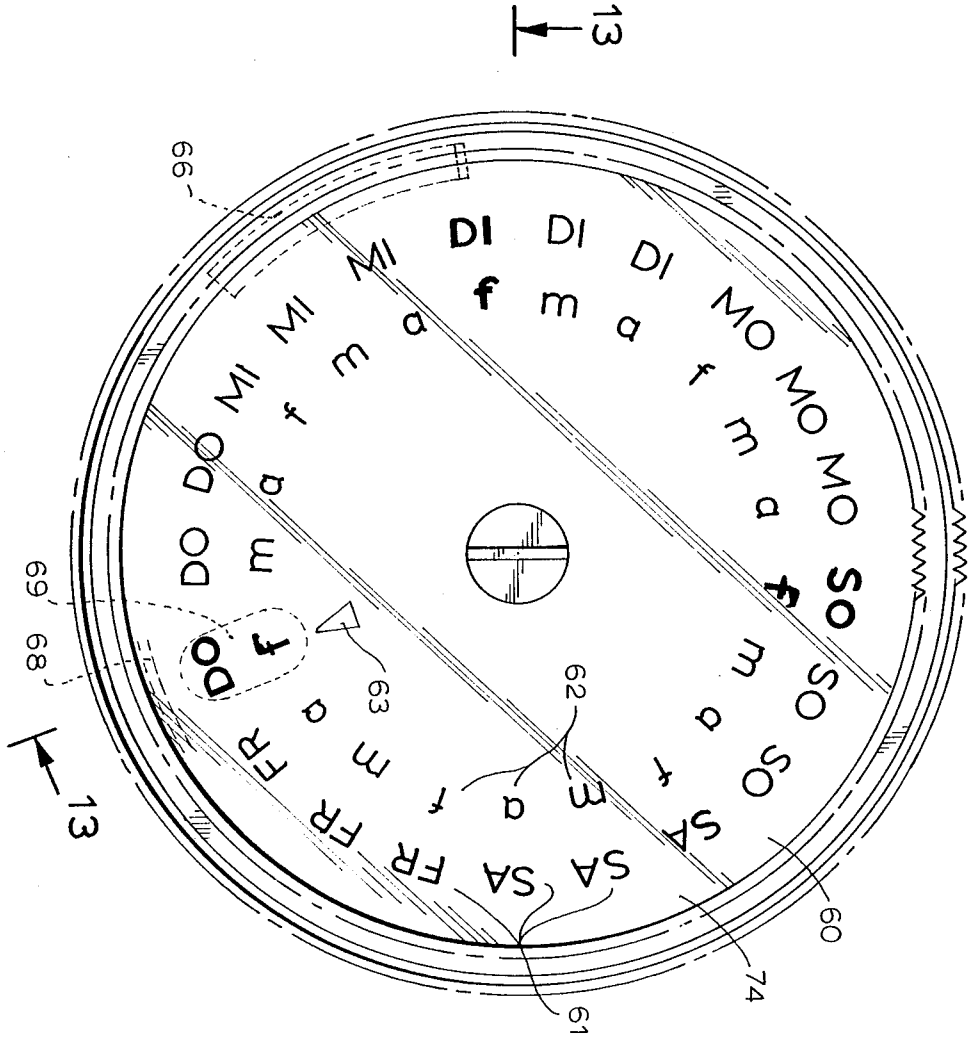
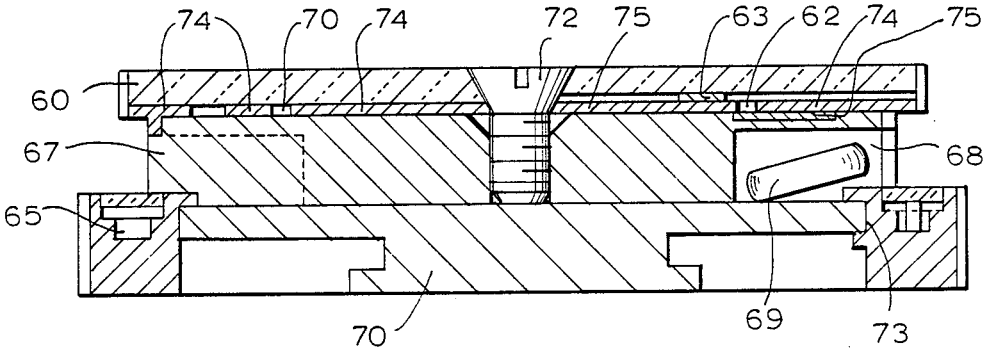
FIG.13

INDICATOR FOR TAKING MEDICATION

BACKGROUND OF THE INVENTION

The present invention relates generally to an indicating instrument for taking medication. Counting instruments with indicating devices are known. In general, a counting sequence is registered by framing a certain figure, for instance by a "window", and then replacing it by the next figure in the sequence. Alternatively, a pointer is moved from one figure, symbol, color, etc to another.

Upon completion of the foregoing movement or coincidence of a pointer with a certain position, such a movement represents the current state of the count. Markings used in conjunction with taking medications are of particular significance. The state of the art includes a great number of pill boxes or other devices that register the number of tablets withdrawn or which serve as a reminder for taking medications, in combination with a clock timer.

These devices, however, have one common disadvantage, namely, they are very expensive. Further, such counting and indicating devices are not at all handy where they also serve as storage and dispensers of tablets, capsules, etc., because tablets and capsules exist in a variety of different shapes and dimensions. Thus, these devices must necessarily be of a large size.

Further, reading or counting from these instruments is a very sophisticated and confusing task, because information required for a successful therapy varies. For instance, certain medications must be taken in the morning, at lunchtime, and in the evening; others are to be taken once a day only in the morning, afternoon or evening; still others are to be taken every second day.

On top of all this, elderly people have to face such varying sequences for taking capsules, tablets, etc. Complicated readings and methods prove to be confusing and not very practicable. The present invention solves these problems in a straightforward manner.

A typical counter, depicted in U.S. Pat. No. 2,805,024 (Olson 1957), has a rotatable dial with radially spaced digits behind a front face with a window. A single digit is visible through the window. A pawl interacts with ratchet teeth about the circumference to releasably secure the rotary positions in which the digits are visible through the window.

It is not practical to display more than one piece of information at a time through a single window. Thus, correlation of meaningful data is virtually impossible. Further, in order to get a desired color contrast, each digit must be carefully painted the appropriate color. Changing the color of the digits after they are painted on is a difficult, time-consuming task. Thus, this device is not readily adaptable for situations where the time for taking medication is variable.

SUMMARY OF THE INVENTION

It is an object of the present invention to provide an indicator for taking medications such as capsules and tablets.

In keeping with this object and with others which will become apparent hereinafter, one aspect of the invention resides, briefly stated, in an indicator for taking medication having a first plate with a background color and at least one colored portion of a different color; a second plate independently movable on the front face and having windows formed so that the colored portion is visible through at least one of them so as to form a plurality of indicator positions; and means for holding the plates movable relative to one another and releasably fixable in each of the indicator positions in which only the colored portion is visible through a respective one of said windows, which are shaped as alphanumeric characters and as slots.

It is another object to provide an indicator which keeps track of the time of day for taking medication by moving plates relative to each other such that a colored portion becomes visible under a corresponding window. Such a contrast between the colored portion and the rest of the device enhances the readability of the window.

It is a further object to simultaneously provide additional information depending upon the particular day or number of tablets of medication already taken, such as a viewable warning signal in a particular color.

It is yet another object to provide a way in which the indicator may be clasped onto a medication bottle.

It is still another object to provide an indicator for counting the number of individual tablets, capsules, or sprays already taken to keep track of the amount of medication administered.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 1 is a top view of a plate-shape embodiment of the present invention;

FIG. 1*a* is an elevational view of FIG. 1;

FIG. 2*a* is a left side view of a roller-shape embodiment of the present invention;

FIG. 2*b* is an end view of FIG. 2*a;*

FIG. 2*c* is a partially broken right side view of FIG. 2*b;*

FIG. 3*a* is a left side view of a tube-shape embodiment of the present invention;

FIG. 3*b* is an end view of FIG. 3*a;*

FIG. 3*c* is a partially broken left side view of FIG. 3*b;*

FIG. 4*a* is an end side view of a slider embodiment of the present invention;

FIG. 4*b* is a top view of a slider panel of FIG. 4*a;*

FIG. 9 is a top view of another embodiment correlating the days of a week to a particular date in a month;

FIG. 10 is a cross-sectional view taken across section lines 10—10 of FIG. 9;

FIG. 11 is a top exploded view of certain components in FIG. 10;

FIG. 12 is a top view of an additional embodiment correlating the time of day with the day of the week and also having a tablet dispenser; and FIG. 13 is a cross-sectional view taken across section lines 13—13 of FIG. 12.

DESCRIPTION OF THE PREFERRED EMBODIMENTS

Figure 5:
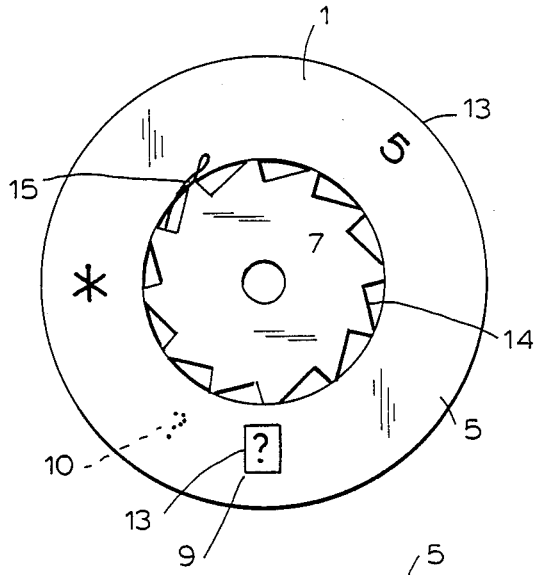
FIG. 5 is a top view of the plate embodiment of FIG. 1 but in greater detail.
Figure 5A:
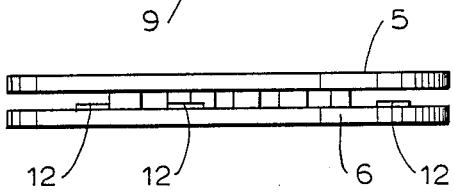
FIG. 5*a* is a side view of FIG. 5.
Figure 6:
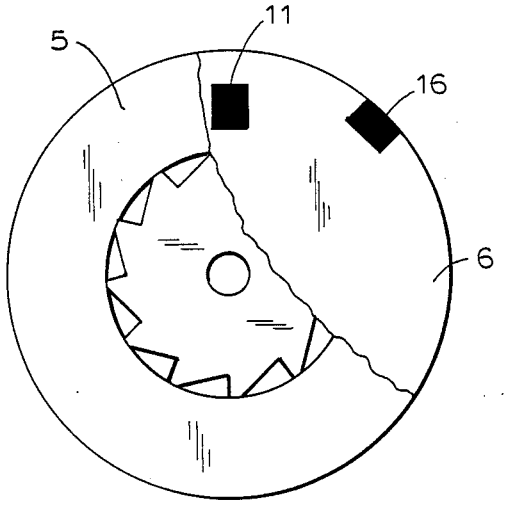
FIG. 6 is a top view as in FIG. 5 but with a portion broken away to show the disc underneath.

Referring now to the drawings, counting and indicating devices for taking medication are shown. Preferably, the device is shaped as a flat, dish-shaped device 1 as depicted in FIG. 1, or as a roller-shaped device 2 as depicted in FIG. 2, or as a tube-shaped device 3 as depicted in FIG. 3, or as a square sliding device 4 as depicted in FIG. 4. A transparent sight piece 5 is partly covered by a coat of paint and is pivotally or slidably movable above an indentically colored background surface 6 around an axis 7 or on a rail 8. The sight piece 5, which is made from transparent material, e.g. glass or the like, becomes partially covered with color 9. The uncovered portion 10, located in front of an identically covered background surface 6, is not visible.

At a certain points 12, the background surface 6 is given a coat of paint. This coat of paint appears through the uncovered portions 13 located in the sight piece 5 of the dish-shape 1 when the sight piece 5 is rotated around the axis 7. When sight piece 5 is rotated, it decelerates from or engages with recesses 14 arranged at specific indexed locations, yet is easily releasable therefrom, by means of a spring 15 or magnet, etc.

If the coat of paint is applied on certain areas corresponding to the indexing increments, for instance on the outer edge of the background area 16, all uncovered portions of the characters arranged along the same radial level on the sight piece 5 appear individually. Precise positioning is achieved by the appropriate index of the engaging mechanisms.

The easily releasable engagements of the sight glass 5, roller 2, slide 4, etc., which are located in specified intervals, results in the uncovered portions appearing through and becoming visible individually relative to the coat of paint of the background surface 5, which is visible through other levels and positions of the sight piece 5.

The dish-shaped device 1 permits the appearance of weekdays, numbers, colors, etc. as various radial levels. Together, they represent a combination of information which simultaneously excludes other extraneous information, because other uncovered portions do not have a contrasting color underneath. As for rollers, this combined information appears on various superimposed tracks 17. These tracks are arranged juxtaposition also on a square, flat slide 4, thereby permitting the combined information to be read.

Figure 7:
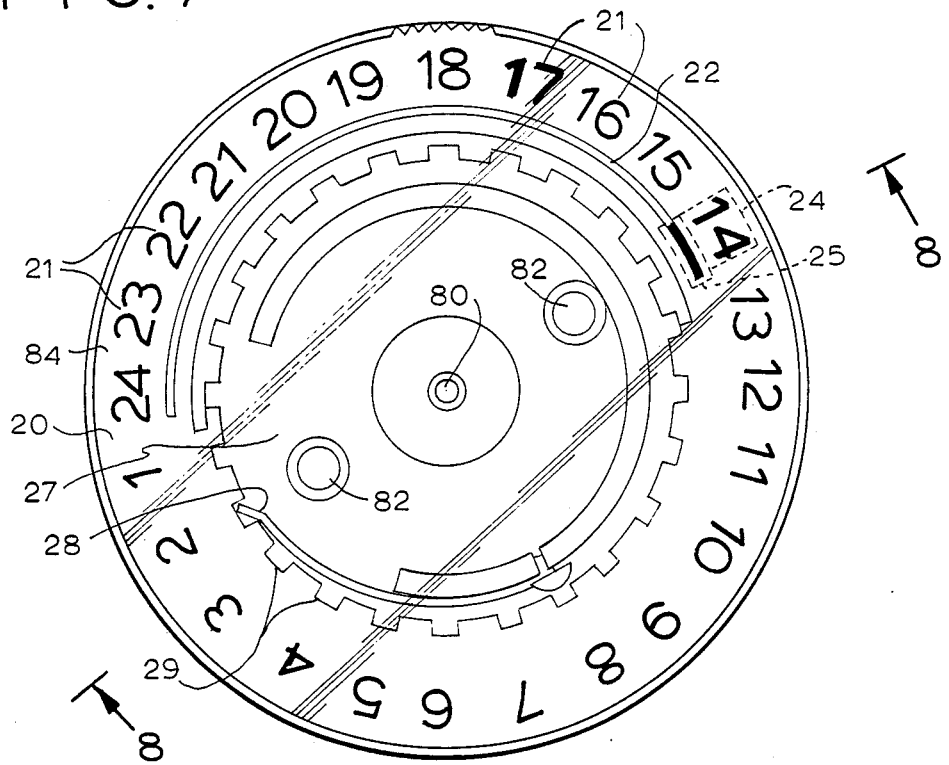
FIG. 7 is a top view of a further embodiment for counting medication taken.
Figure 8:
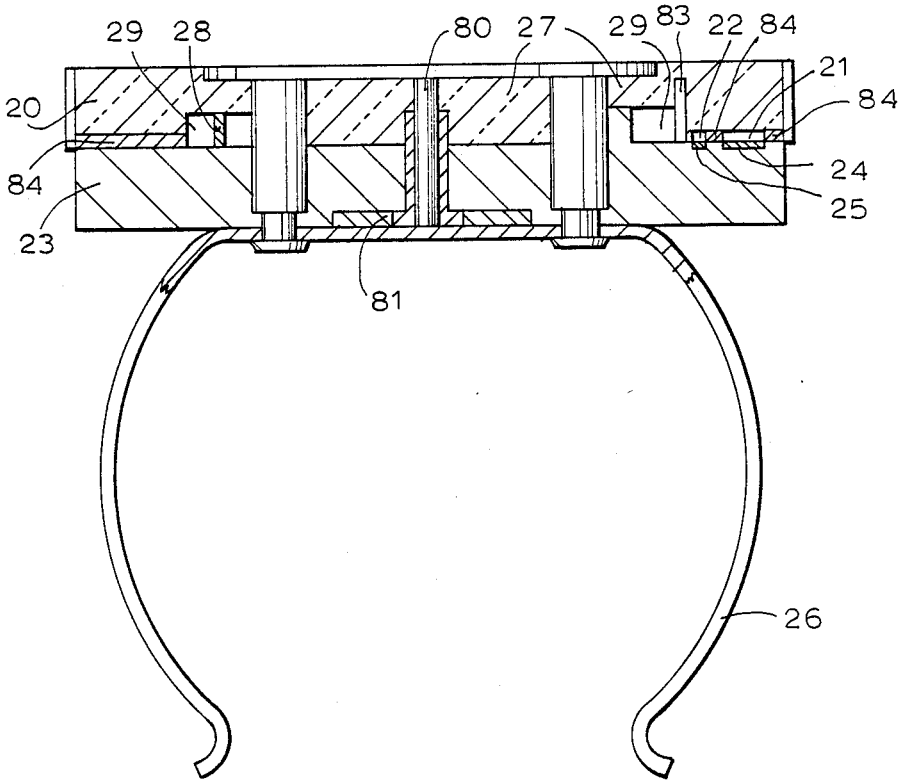
FIG. 8 is a cross-sectional view taken across section lines 8—8 of FIG. 7.

In the embodiment of FIGS. 7 and 8, there is a transparent ring 20, which has a painted layer 84 with unpainted radially-spaced window 21 formed as numbers, representing a sequential count—e.g., for keeping track of the number of sprays administered or tablets or capsules taken. There is also an unpainted radial slot 22 spaced inward from a series of windows 21. Thus, the windows are negatively imprinted.

Some of the windows shaped as characters 21 are depicted double lined, e.g., "17". However, all should appear double-lined with an unpainted space therebetween; for convenience, most of the windows were represented by single-lines. The same applies for windows shown in FIGS. 9 and 12.

A disc 23, painted on its top surface with the same color as the painted layer, supports ring 20. Two different colored strips, 24, 25, are fixed onto the surface of the painted disc 23 so that their color may become visible through the windows 21 and slot 22 respectively. In this manner, all the other windows 21 appear to have the same color as the rest of the painted layer and therefore blend in. The slot can be used to signify a warning—e.g. the nearing of the end for taking medication.

The ring 20 surrounds an inner disc 27. The disc 23 has a raised C-shaped projection on its top face. There is a groove in this raised projection for receiving the end of a biasing spring 28. A blocking projection is also raised on the top face of the disc 23 between the C-shaped projection and the ring 20 by the slot in the C-shaped projection so that the spring 28 will not release itself from the slot horizontally. The ring has a plurality of recesses 29 for receiving the other end of the spring 28, into which the spring biases to releasably hold the ring 20 and disc 23 together in place. A circular groove 83 rests on top of the C-shaped portion and is between the disc 27 and the ring 20.

Two holes 82 pass through the disc 27 and disc 23 so that a C-shaped holder 26 may be secured by two fasteners passing through the holes to a cover, which has a diameter equal to the disc 27. A label may be printed on the cover. The holder 26 may be made from bendable metal and clasps around a spray or medicine bottle to remain with the bottle throughout.

A central hole passes through all the discs and a metal tube 80 is inserted, to provide a common pivot point. The tube has a wider diameter bottom end, which fits into a groove in a circular holder 81. The holder 81 is fitted into a circular recess on the bottom of disc 23. The recess is shaped to allow for a flush bottom surface when holder 81 is in place. When in place, the holder 81 presses against the disc 23.

The orientation of the spring 28 permits a turning of the ring 20 in one direction only relative to the discs.

In the embodiment of FIGS. 9 and 10, there is an inner disc 30 with a bevelled center hole 43, a bevelled circumferential edge, and a transparent body with a painted layer. Only radially spaced windows 33, representing a sequence of days in a week, are left unpainted. A projection 40 extends radially outward from the bevelled outer edge.

An outer ring 31, also made of transparent material, has a painted layer 50 with unpainted radially-spaced windows 34, 35, representing a slot and a sequence of days in a month respectively. The ring's 31 inner edge is bevelled to mate with the outer bevelled edge of the disc 30, so as to provide support. However, the inner bevelled edge of the ring 31 also has a plurality of radial grooves corresponding to each of the images 35. Each groove is sized to receive the projection 40, thereby fixing the ring 31 and disc 30 together when horizontally positioned. A circumferential groove 41 is spaced away from the windows 34, 35 in the ring 31 and has a plurality of radial slots 32 corresponding to each of the windows 35.

The disc 30 and ring 31 are supported on top of a painted disc 44, which preferably has a surface color which is the same as the other painted layer. Absent any additional colorings, all the unpainted windows should appear to have the same color as the rest of the surfaces of the ring 31 and disc 30.

A biased spring 37 is fastened to the top of the painted disc 44 and fits within the groove 41 when the outer ring 31 is placed into position on the painted disc 44. The spring 37 biases into the slots 32 to releasably fix the position of the outer ring 31 relative to the painted disc 44.

A colored strip 45 is fixed radially on the painted disc 44, e.g. taped, such that one of each window 33, 34, 35 is aligned directly above the colored strip 45 when the spring 37 is biased into one of the slots 32. The colored strip 45 is a different color than that of the painted layers or the rest of the painted disc 44. In this manner, the images 33, 34, 35 over the colored strip 45 are contrasted against the rest of the surfaces. The painted disc also has a central hole and a recessed circular region on its underside. As also seen in FIG. 11, a washer 47, elevated ring 48 and screw receptor 49 are fitted into the recessed region. A screw 38 with a bevelled head is fitted into the complementary bevelled center hole 43 of the inner disc 31 and passes through the central hole of the painted disc 44 and screwed into the screw receptor 49. In this manner, all the pieces are firmly held together, but the upper pieces (disc 30, ring 31) are pivotally movable relative to the painted disc, subject to being releasably held in position by the spring 37. The inner disc 30 may be moved independent of the outer ring 31 by a loosening of the screw 38 and keeping the screw receptor 49 bottom flush with the bottom of the painted disc 44. The inner disc 30 is rotated until the projection 40 rests in a desired groove. In this way, the day of the week in the disc 30 can be correlated with the day of the month on the outer ring 31. If desired, a different colored strip 36 can be placed under certain windows (e.g., numbers of days 35) to indicate a time in which no medication is to be taken. The window slot 34 may be of any desired circumferential length so that only certain days 35 are flagged by this feature to indicate a warning—e.g. the need for a refill. Due to the biasing direction of the spring 37, and the shape of the slots 32, the outer ring 31 can only be turned in one radial direction relative to the painted disc 44.

In the embodiment of FIGS. 12 and 13, the operation is very similar to that of the embodiment of FIG. 9, except that there is no independently movable inner disc. Here, a transparent disc 60 is painted with a solid layer of color 74 except for radially spaced windows 61, representing a sequence of days of the week and associated radially-spaced windows 62, representing times of the day (e.g., morning, afternoon, night). The disc 60 is fitted on a painted disc 67 of a matching color. A spring 66 still biases into grooves 65, but the arrangement is vertical instead of horizontal. Since the grooves 65 similarly correspond to each of the windows 61, the disc 60 is releasably held into position relative to the painted disc 67. A colored strip 75 of a different color is taped or otherwise fixed to the top of the painted disc 67 to provide contrast through a set of associated windows 61, 62 as compared to the rest of the surface. An arrow 63 points to the direction of a side slot 68. A circular transparent disc 70, having radial projections, is fixed to the painted disc 67 by placement into grooves 73. The bottom of the painted disc 67 has a plurality of grooves 70 corresponding to each of the windows 61 for the placement of pills 69. At most, one pill (or a set of pills) is removable through the slot 68, at any one position. In this way, the dispersement of pills is regulated with the time of day to prevent situations where a person forgets whether or not medication was taken. A bevelled head screw 72, fitted into a bevelled hole in the center of disc 60 and a hole in the center of painted disc 44, pivotally holds the two together. A part of disc 70 also serves as a turning handle for turning the disc 70 so that its projections can fit within the grooves 73. Due to the shape of the grooves 65 and the biasing direction of the spring 66, the two discs 60, 67 are turnable relative to each other in only one radial direction. Pills 69 are placed in grooves 70 after removal of disc 70.

While the forementioned embodiments utilize images on a transparent surface, the same effect is achieved where the images are cut-outs or openings in a foreground surface. Such a variation is yet another embodiment of the present invention.

It will be understood that each of the elements described above, or two or more together, may also find a useful application in other types of indicators differing from the types described above.

While the invention has been illustrated and described as embodied in an indicator for taking medication, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An indicator for taking medication comprising:

a first plate with a background color and at least one colored portion of a color different than said background color to provide contrast;

a second plate independently movable on said first plate and having a plurality of alphanumerically formed windows each formed to have an alphanumeric shape and so that said colored portion appears in said windows alternatively during which only said colored portion is visible through each of said windows so as to form a plurality of indicator positions; and releasably fixing means for releasably fixing said first plate and said second plate together in each of said indicator positions, said releasably fixing means including an engaging member fixed to one of said plates, the other of said plates having a plurality of receiving areas corresponding to each of said indicator positions, said engaging member being formed to engage with a respective one of said receiving areas by spring biasing into said respective one of said receiving areas to thereby releasably fix said plates together.

2. The indicator as defined in claim 1, wherein said receiving areas are formed as slots.

3. The indicator as defined in claim 1, wherein said engaging member is formed so that said plates are movable relative to each other in only one direction.

4. The indicator as defined in claim 1, wherein said releasably fixing means includes a member pivotally holding said plates together.

5. The indicator as defined in claim 1, wherein said releasably fixed means includes a member slidably holding said plates together, said plates being slidably movable relative to each other.

6. The indicator as defined in claim 1, wherein said second plate is composed of transparent material; further comprising: a colored layer in said second plate of a color identical to said background color, said layer surrounding said windows to thereby define a shape of said images.

7. The indicator as defined in claim 1, wherein said second plate has a color between said windows different from said color of said colored portion.

8. The indicator as defined in claim 1, wherein asid plates are disc-shaped, said plurality of windows being circumferentially spaced apart from each other at a common radial level.

9. The indicator as defined in claim 1, wherein said windows are formed to represent a scaled sequence.

10. The indicator as defined in claim 1; further comprising:

a holder attached to one of said plates and releasably fixable to a container for medication.

11. The indicator as defined in claim 1, wherein said windows are arranged into at least two sets of windows, said colored portion being arranged to be visible simultaneously through at least one of said windows from each of said sets.

12. The indicator as defined in claim 1, wherein said second plate has an additional colored portion visible through at least one of said windows.

13. The indicator as defined in claim 1, wherein said second plate has a slotted window formed as a circumferential slot, said colored portion being arranged to be visible through said slotted window in at least one of said indicator positions as well.

14. The indicator as defined in claim 1, wherein said colored portion is removably fixed to said first plate.

15. An indicator for taking medication, comprising:

a first plate with a background color and at least one colored portion of a color different than said background color to provide contrast;

a second plate independently movable on said first plate and having a plurality of alphanumerically formed windows each formed to have an alphanumeric shape and so that said colored portion appears in said windows alternatively during which only said colored portion is visible through each of said windows so as to form a plurality of indicator positions;

releasably fixing means fo releasably fixing said first plate and said second plate together in each of said indicator positions, said second plate having an inner portion and an outer portion, said inner portion being arranged radially inside of said outer portion, each of said portions having a plurality of said windows, said colored portion being arranged to be simultaneously visible through at least one of said windows of each of said portions; and means for releasably fixing said inner portion to said outer portion so that said inner portion and said outer portion are alternatively movable independently of each other and movable in association with each other.

16. An indicator for taking medication, comprising:

a first plate with a background color and at least one colored portion of a color different than said background color to provide contrast;

a second plate independently movable on said first plate and having a plurality of alphanumerically formed windows each formed to have an alphanumeric shape and so that said colored portion appears in said windows alternatively during which only said colored portion is visible through each of said windows so as to form a plurality of indicator positions;

releasably fixing means for releasably fixing said first plate and said second plate together in each of said indicator positions;

a third plate;

means for attaching said second and third plates together such that a space forms therebetween for placement of medication; and means for dispensing said medication from said space between said second and third plates and including a plurality of openings formed in one of said second and third plates so as be peripherally open, and a further opening formed in and movable with said first plate and also being peripherally open, said further opening being arranged to align with one of said plurality of openings when said first and second plates are at a corresponding one of said indicator positions.

17. The indicator as defined in claim 16, wherein one of said second and third plates has a plurality of grooves into which said medication is individually receivable.

* * * * *